United States Patent [19]

Michel

[11] 3,999,457

[45] Dec. 28, 1976

[54] KEY SYSTEM FOR CONTROLLING THE RATE OF ATTACK IN ELECTRONIC MUSICAL INSTRUMENTS

[76] Inventor: Adolf Michel, Ulrichs-Au 1,, D-8124 Seeshaupt, Germany

[22] Filed: Aug. 30, 1974

[21] Appl. No.: 502,093

Related U.S. Application Data

[63] Continuation of Ser. No. 341,263, March 14, 1973, abandoned.

[30] Foreign Application Priority Data

Mar. 17, 1972 Germany ..... 2213110
Oct. 3, 1972 Germany ..... 2248384

[52] U.S. Cl. ..... 84/1.01; 84/1.12; 84/1.13; 84/1.19; 84/1.21

[51] Int. Cl.[2] ..... G10H 1/00

[58] Field of Search ..... 84/1.01, 1.11, 1.12, 84/1.13, 1.19, 1.21, 1.26, DIG. 7, DIG. 19, DIG. 8, DIG. 23, 1.1

[56] References Cited

UNITED STATES PATENTS

| | | | |
|---|---|---|---|
| 2,873,637 | 2/1959 | Herold | 84/DIG. 7 |
| 3,011,379 | 12/1961 | Corwin | 84/1.19 |
| 3,297,812 | 1/1967 | Cordry | 84/1.01 |
| 3,507,970 | 4/1970 | Jones | 84/1.01 |
| 3,509,263 | 4/1970 | Cordry | 84/1.26 |
| 3,516,321 | 6/1970 | Harris | 84/1.26 X |
| 3,544,695 | 12/1970 | Dijksterhuis | 84/1.13 |
| 3,544,699 | 12/1970 | Harris | 84/1.26 |
| 3,626,074 | 12/1971 | Hiyama | 84/1.13 X |
| 3,627,895 | 12/1971 | Savon | 84/DIG. 23 |
| 3,634,594 | 1/1972 | Hiyama | 84/1.01 |
| 3,636,231 | 1/1972 | Schrecongost et al. | 84/1.11 X |
| 3,697,662 | 10/1972 | Adachi | 84/1.13 |

*Primary Examiner*—Ulysses Weldon
*Attorney, Agent, or Firm*—Donald D. Jeffery

[57] ABSTRACT

This invention relates to a key system for electronic musical instruments, comprising a key circuit for forming control signals and control circuits for transmitting sound signals in response to the control signals. The key circuit produces the control signals in dependence on the position of a key and/or on elapsed time after depression of the key. Coupling means forming part of each control circuit modifies transient characteristics of the control signals whereby each control circuit can transmit notes in such a way that they each have a different build-up time. This enables the instrument to make a sound similar to that produced by a conventional non-electronic instrument.

7 Claims, 9 Drawing Figures

KEY SYSTEM FOR CONTROLLING THE RATE OF ATTACK IN ELECTRONIC MUSICAL INSTRUMENTS

This is a continuation of application Ser. No. 341,263, filed Mar. 14, 1973, now abandoned.

BACKGROUND OF THE INVENTION

1. Field of the Invention

The invention relates to a key system for electronic musical instruments.

2. Description of Prior Art

In the case of proposed contactless key systems which consist of a contactless control unit and of electronic sound controls, which open (i.e., allow passage of the sound signal) in dependence upon a control voltage or control current there is the disadvantage that although the notes start up softly the time of build-up is the same for all notes.

If, for example, an organ has 30 keyboard stops and 60 keys in the keyboard, then the number of sound controls required between a sound producer and an amplifier of the organ amounts to 1800. If, as is desirable, these sound controls open at different times, then the rate of increase of the control current or of the control voltage must be different. This rate of increase can be controlled by means of an R-C network (with C major) or an R-C network including an impedance transformer (with C minor). Taking into account the number of controls needed, namely 1800, it will be recognized that a key system of this type involves a large amount of equipment which necessitates great spatial requirements and expenditure.

Also, alterations of the time-dependent characteristics of the control voltages in the individual keys would only partially solve this problem, since for example, a trumpet, in relationship to a principal note of equal basic frequency, has a substantially shorter so-called "tone response" (build-up period) than some other instruments.

With regard to this, every musical instrument with mechanically produced notes has a quite definite individual tone response; this term designates the behavior, in time, and according to the frequency, during the build-up period of the note produced. This is in contrast to a resonant circuit which, when excited, begins to oscillate at its resonant frequency, with amplitude constantly increasing from zero until it has reached a relatively steady state having a constant oscillation amplitude. This behavior is normally described with reference to the transient time. In the tone response of an instrument, the sound sets in almost immediately with a substantial amplitude but with a frequency which is at first different from the required frequency. As the amplitude increases the frequency changes to the required frequency. This behavior is designated as "spitting" in the case of wind instruments, e.g., flutes or organs.

The present invention aims to provide a key system which involves relatively low expenditure to build, but enables individual oscillation build-up of each individual note of a register.

SUMMARY OF THE INVENTION

According to the invention there is provided a key system for electronic musical instruments, comprising: key circuits each including a key and means for forming a control signal in dependence on the position of the key and/or on elapsed time after the depression thereof; electronic sound control circuits coupled to the key circuits and including means for transmitting sound signals for individual register notes of the instrument in response to the control signals from the key circuit; and electrical couplings forming part of each control circuit, each such electrical coupling comprising means for modifying transient characteristics of the control signal between said signal forming means and said transmission means.

A particularly simple possibility of making the tone response softer or hard (i.e., slower or quicker) in an instrument provided with the key system according to the invention, is to connect each key circuit to a common electrical supply source and to provide means which can simultaneously adjust the electrical supply to all key circuits.

In one embodiment the couplings of the key circuits each have different time constants and/or their time-constants are adjustable. The time constants of the couplings can be determined by the value of a resistance or of a voltage divider.

The above described embodiments of the key system enable a very good imitation of the normal response of a musical instrument by individual setting of the coupling to give the particular build-up period of the instrument. Nevertheless, a further problem exists in relation to the tone response of an instrument with mechanically-produced notes. Since the pressing of one of the keys, and the resultant rise in the associated control signal is an essentially monotonic process in the mathematical sense, the amplitude (controlled by the sound control) and the waveform of the sound voltage will also vary monotonically. This means a monotonic transition occurs from the initial condition (smallest amplitude and greatest distortion) to the end-condition (final amplitude and final waveform). The result is a more or less harmonium-like build-up of the notes. The response, for example, of organ pipes differs musically from this by extensive spitting and by building-up of the pipe notes to reach the required frequency. For purposes of reproducing such an organ response there exist, e.g., in electronic organ construction, certain key circuits which result in pre-keying another (higher frequency) sound voltage before the keyed sound-voltage. The disadvantage of this method is that, due to the different sources, the organic connection between the gradual rising and building-up of notes and/or the built-up notes is interrupted, and this is musically audible.

In a further solution to this problem that has been proposed, after keying (e.g., contact keying) of the sound voltages has been performed, these latter are combined register-wise or in other groups and are musically keyed once again. The greatest disadvantage of these circuits is that they only become effective in cases when the first of the keys is pressed.

This disadvantage can be avoided or mitigated by a further development of the invention, wherein each of the key circuits forms at least two control signals and the associated electronic sound controls vary the amplitude and waveform of the sound signals. In a preferred embodiment of this further development, whereby a practically true-to-nature tone response can be produced, each key circuit forms the first control signal in dependence on the position of the key and the second control signal in dependence on time. The associated control circuits are initially responsive to the first control signal and then to the second control signal.

A further possibility of influencing the tone response comprises connecting an adjustable voltage source in a supply line from each key circuit to the associated control circuits to vary the degree of distortion of the keyed sound signals.

In all embodiments of the key system according to the invention, the key circuits can include contactless switches whereby control signals dependent on the position of the keys can be obtained.

DESCRIPTION OF PREFERRED EMBODIMENTS

Examples of key systems in accordance with the invention will now be described with reference to circuit diagrams and explanatory diagrams in the accompanying drawings, in which.

Figure 1:
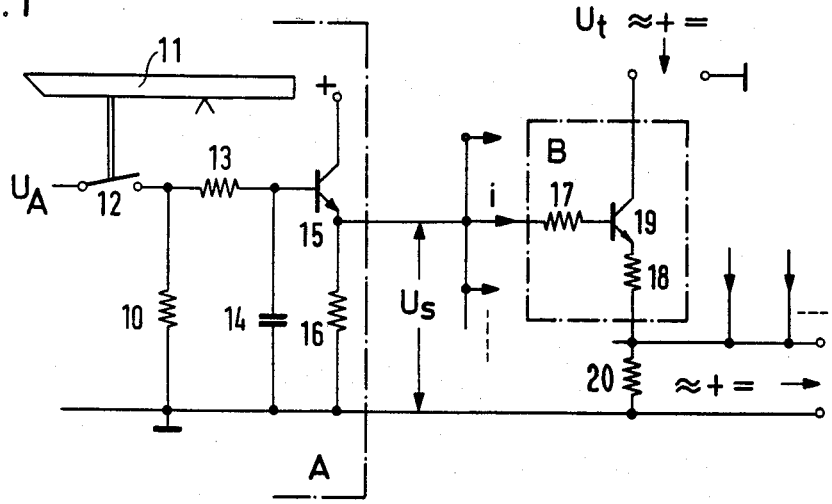
FIG. 1 is a circuit diagram of a first embodiment of the invention.
Figure 2:
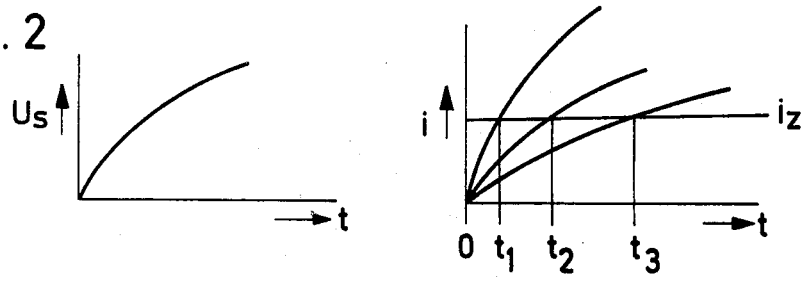
Figure 3:
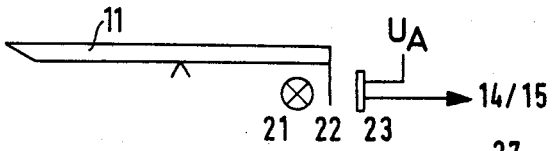
Figure 4:
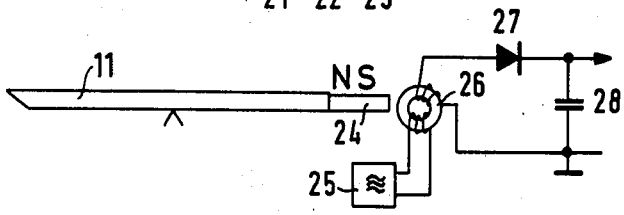
Figure 5:
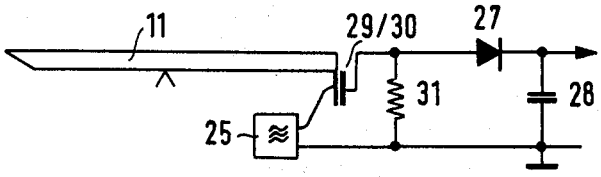
Figure 6A:
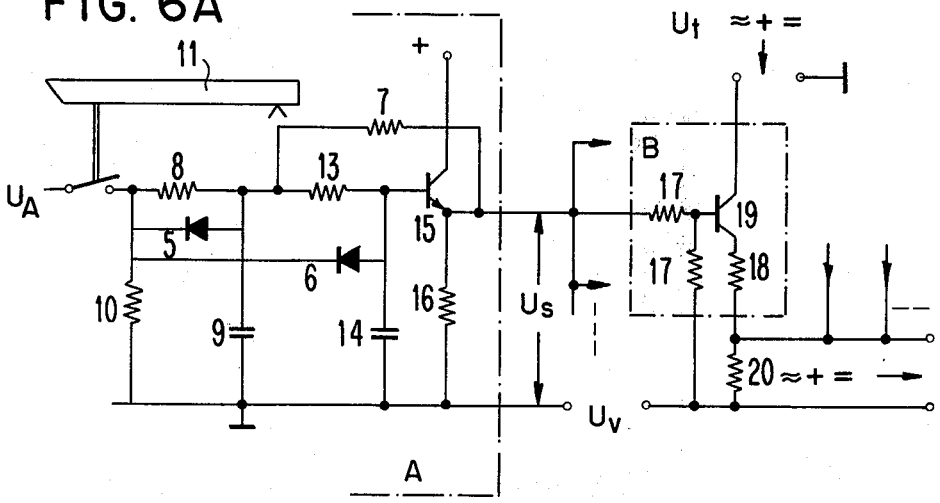
Figure 6:
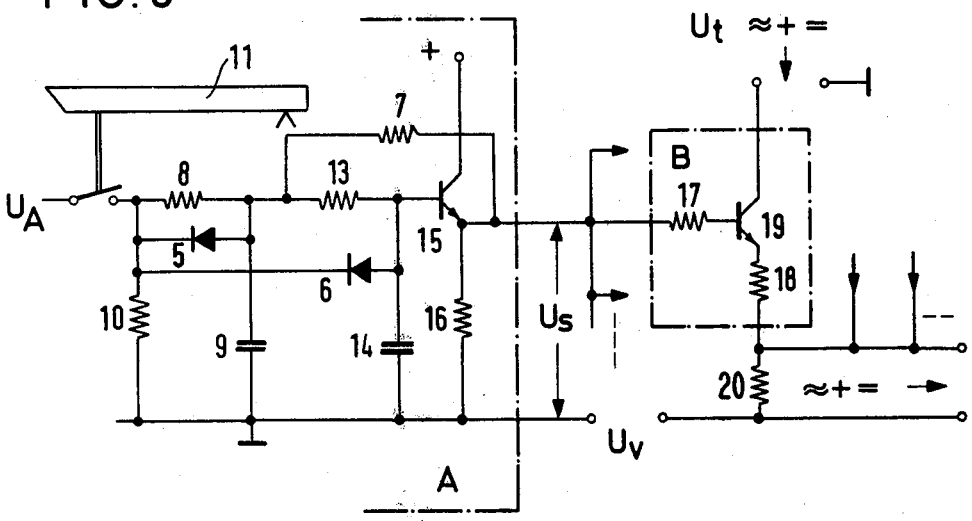

FIG. 2 comprises two graphs showing the time-dependent characteristics of the control voltage and of the control current in the circuit according to FIG. 1;

FIGS. 3 to 5 show different contactless key circuits;

FIG. 6 is a circuit diagram of a further embodiment of the invention for producing two control voltages having a different course in time, and which are combined to form one single control voltage $U_S$;

FIG. 6A is a modified circuit diagram of the embodiment of FIG. 6.

Figure 7:
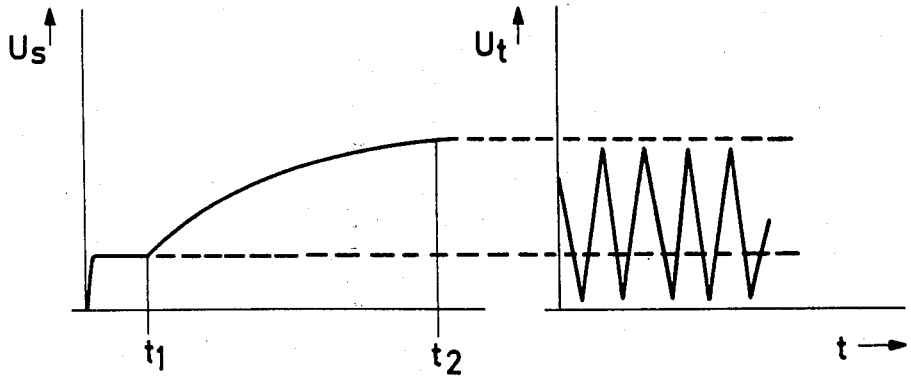

FIG. 7 is a graph showing the time-dependent characteristics of the control voltage $U_S$ of the circuit according to FIG. 6, and of the sound voltage $U_t$.

FIG. 1 shows a first embodiment of the key system according to the invention, in a simplified circuit diagram. The system comprises a key circuit A and a plurality of sound control circuits B (only one of which is shown in the interest of clarity), one circuit B being provided for each note of a register. The circuit A comprises a key 11 and a switch 12 connected to one terminal of a voltage supply source $U_A$, the other terminal of which is earthed. By pressing the key 11, the switch 12 is closed supplying the voltage $U_A$ to the circuit. A capacitor 14 is charged to the voltage $U_A$ through resistance 13 connected in series with the switch 12. The voltage across the capacitor 14, reduced by the emitter-base voltage of a transistor 15 is supplied to a resistance 16, which is connected to the emitter of the transistor 15. The circuits B are controlled by the voltage across the resistance 16 or the current from the emitter. In fact each circuit B is a network comprising a transistor 19, a base resistance 17 and an emitter-resistance 18 in this embodiment. A sound frequency signal $U_t$ (with direct current part) is supplied to the collector of each transistor 19 and the output voltage is taken from across a resistance 20.

In FIG. 2, the left-hand diagram illustrates variations of the value of the control voltage $U_S$ with respect to time and the right-hand diagram illustrates the variations of the control current $i$ for different values of the coupling resistances 17 in dependence on time (these curves are called $i$ curves). The horizontal line $i_z$ indicates the base current at which the resistance of transistor 19 becomes negligibly small in relation to the resistance 18. The intersection points of the horizontal $i_z$ line with the curved lines give, on the $t$-abscissa, the transient periods $t_1$ to $t_3$ needed to reach $i_z$ when the circuit B includes different coupling resistances 17.

Referring again to FIG. 1 and to the left-hand diagram of FIG. 2, the asymptotic end point of each $i$ curve (in the left-hand diagram) is dependent upon the supply voltage $U_A$. Increasing $U_A$ results in steeper $i$ curves in the right-hand diagram of FIG. 2 and thereby in a more rapid change in the resistance of transistor 19. Thus it is possible, by varying the supply voltage $U_A$ in FIG. 1 (or the HF initial voltage of a generator 25 in FIGS. 4 and 5, which will be discussed later) to make the tone response of the instrument softer or harder, without blurring the differences within the instrument.

If one looks at the sound control circuit B in FIG. 1 then it can be seen that the base current $i_z$ flowing via the resistance 17 also produces an undesirable increased voltage drop across the resistance 20. Therefore the base current $i_z$ should not be allowed to become too great. The circuits B which are associated with the left-hand keys of a keyboard open more slowly then do those at the right-hand end of the keyboard. This can be taken into account in the key circuit A for each key. For this purpose the resistance 13 and/or the capacitor 14, of each key circuit are of different values or are adjustable to control the current $i_z$.

Figure 1A:
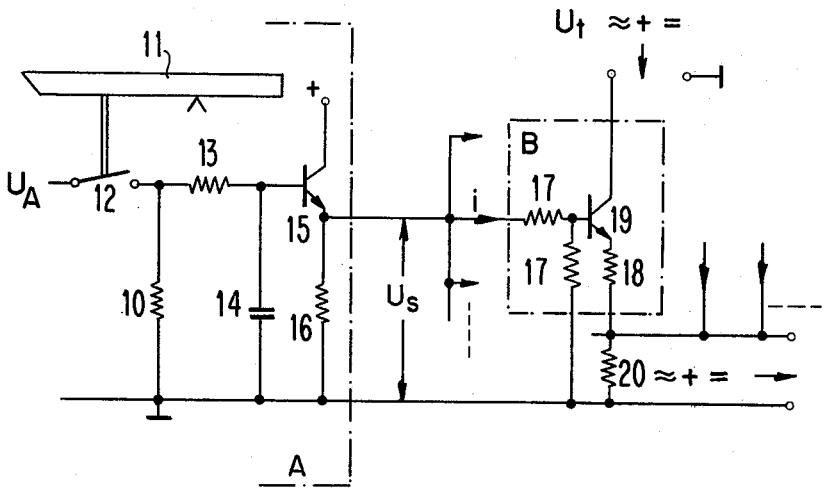
FIG. 1A is a modified circuit diagram of the embodiment of FIG. 1.

Instead of the current-controlled circuit B of FIG. 1, it is also possible to use the voltage-controlled circuit B′ of FIG. 1A, in which case, the coupling resistance 17 must have a further resistance 17*a* added to it, so as to form a voltage divider.

In an advantageous development of the circuit according to FIG. 1 the switch 12 is contactless. Thereby one obtains a more progressive increase in sound, which can be controlled by the player. In FIGS. 3, 4 and 5, three devices are shown. Each produces a control voltage in dependence upon the position of the key. In FIG. 3, this is done by means of a device comprising a lamp 21, a shutter 22 connected to and movable with the key 11, and a photo-resistance 23 which replaces the resistances 10 and 13 and is connected to the base of transistor 15 and to capacitor 14 in FIG. 1. Pressure on the key moves the shutter from between the lamp 21 and photoresistance 23, the amount of light reaching the photoresistance 23 and therefore the current supply to the base of transistor 15 varying in dependence on the position of the key 11.

FIG. 4 shows a magnetic key circuit. A permanent magnet 24 with poles N,S is coupled with the key 11 and varies, in dependence on the key position, the permeability of a transformer 26. Voltage is supplied to the transformer by a high frequency generator 25 and the output from the transformer is rectified by a diode 27. A capacitor 28 is in parallel with the secondary winding of the transformer and the diode and the voltage across this capacitor varies in dependence on the permeability of the transformer.

In FIG. 5, the HF generator 25 supplies voltage to a resistor 31 via a capacitor 29,30, one of whose plates 29 is movable and is connected with the key 11. After rectification by the diode 27 the HF voltage from the capacitor charges the capacitor 28 to a voltage whose value is dependent upon the position of the key 11.

A tone-response similar to that of pipe organs can be obtained by means of sound control circuits which, in dependence upon the control voltage or of the control current, vary not only the amplitude of the sound voltage, but also its waveform; for example by amplitude limiting and/or phase intersection.

FIG. 6 shows an example of an embodiment of the key system wherein two control voltages are produced.

As in FIG. 1 pressing the key 11 closes the switch 12 and the capacitor 9 is charged rapidly via the resistance 8 to the voltage $U_A$, whereas the capacitor 14 is charged much more slowly via the resistance 13. A resistance 7 is connected from the connection point between a resistance 8 and a capacitor 9 directly to a control line which is connected to the emitter resistance 16 and to the emitter of the transistor 15. Thus the potential at the connection point between elements 8,9 undergoes an additional voltage division due to the resistances 7 and 16, so that the sound valve B is initially controlled by the voltage from the connecting point. This lasts until the charging of the capacitor 14 reaches a higher potential and thereby determines the value of the control voltage $U_S$ which is composed of the two individual control voltages. The capacitors 9 and 14 are discharged via diodes 5 and 6 and the resistance 10 after the key 11 is released.

FIG. 6A shows a further embodiment of the circuit of FIG. 6, in which a voltage-controlled circuit B' is substituted for the current-controlled circuit B.

FIG. 7 depicts, in dependence upon time, the total control voltage $U_S$ composed from the two control voltages, and also the sound voltage across the resistance 20. The sound voltage across the resistance 20 is almost horizontal at the time $t_1$ and then between $t_1$ and $t_2$, changes to adopt the curved waveform of the voltage across resistance 16.

The contactless switches of FIGS. 3, 4 and 5 are also usable here in place of the circuit elements 5, 8, 9 and (if necessary) 10, the contactlessly produced voltages being suitably led directly to the connecting point between the resistances 7 and 13.

A source supplying a voltage $U_V$ is connected between the earth point of the resistance 20 and the earth point of the resistance 16 in FIG. 6 and serves to keep the circuit B non-conductive when in the non-keyed state. By varying the voltage $U_V$ the degree of distortion of the waveform at the time $t_1$ can be controlled.

I claim:

1. A key system for electronic musical instruments having a number of keys, comprising for each key:
   a. a keying means, including a movable key and a switching means operatively connected to said movable key and to a voltage source whereby an electrical control signal dependent on the depression of said movable key is obtained, a signal-modifying circuit means operatively connected to said switching means for electronically modifying said control signal, whereby said modified control signal changes from a first level to a second level in dependence on elapsed time after depression of said movable key and then remains at said second level as long as said movable key stays depressed, and
   b. a plurality of sound control circuit means operatively connected to said signal-modifying circuit means for receiving said modified control signal from said signal modifying circuit means at a first input and an audio frequency signal representing an individual register note of said electronic musical instrument at a second input and for selectively passing said audio frequency signal at a signal output in dependence on the level of said modified control signal from said signal-modifying circuit means, such that when said modified control signal is at said first level the audio frequency signal amplitude at said signal output is at a minimum, when said modified control signal reaches an intermediate level between said first and second levels the audio frequency signal amplitude at said signal output is at a maximum, when said modified control signal level is between said first and said intermediate levels the audio frequency signal amplitude at said signal output is proportionate to the control signal level, and when said modified control signal level is between said intermediate and said second levels the audio frequency signal amplitude at said signal output is at a maximum, each said sound control means comprising an electronic switch having its base operatively connected to said signal modifying circuit means by a resistor and said resistor associated with each said sound control circuit means having a different resistance value, whereby the rise time of said audio frequency signal amplitude at each said signal output is different from that at other of said signal outputs.

2. The key system of claim 1, wherein said signal-modifying circuit includes a resistance-capacitance network.

3. The apparatus of claim 1, wherein said switching means comprises a contactless switch and the level of said modified electrical control signal is further dependent upon the extent to which said movable key is depressed.

4. The apparatus of claim 1, wherein said signal limiting means is provided at the first input of each sound control circuit means for limiting the modified control signal level, thereby increasing the rise time from minimum to maximum of said audio frequency signal amplitude appearing at said signal output.

5. A key system for electronic musical instruments having a number of keys, comprising for each key:
   a. means for producing a steady-state control signal when said key is depressed,
   b. means connected to said signal producing means for extending the rise time needed for said control signal to reach its maximum level, and
   c. a plurality of gates connected to said rise time extending means, each said gate having means for further modifying the rise time of said control signal and for passing to an output an audio frequency signal representing an individual register note of said electronic musical instrument in dependence on said further modified control signal level, whereby the audio frequency signal appearing at the output of each gate after depression of said key rises from zero to a maximum level at a rate different from that of others of said gates and remains at said maximum level while said key remains depressed.

6. The apparatus of claim 5, wherein the maximum levels of said control signal and of said audio frequency signal appearing at the output of each said gate are dependent upon the extent to which said key is depressed.

7. The apparatus of claim 5, wherein the control signal rise time extending means includes a time constant which varies with the control signal level.

* * * * *